US007022025B1

(12) United States Patent
Cascerceri et al.

(10) Patent No.: US 7,022,025 B1
(45) Date of Patent: Apr. 4, 2006

(54) GOLF GRIP-TRAINING DEVICE

(76) Inventors: Frank J. Cascerceri, 84 Golfview Dr., Ivyland, PA (US) 18974; John R. Eccleston, 75 Eisenhard Dr., Ivyland, PA (US) 18974

( * ) Notice: Subject to any disclaimer, the term of this patent is extended or adjusted under 35 U.S.C. 154(b) by 0 days.

(21) Appl. No.: 11/057,839

(22) Filed: Feb. 15, 2005

(51) Int. Cl.
*A63B 69/36* (2006.01)
*A63B 53/14* (2006.01)

(52) U.S. Cl. ..... 473/201; 473/206; 473/300; 473/549

(58) Field of Classification Search ..... 473/201–206, 473/219, 223, 298, 299, 300–303, 523, 538, 473/568, 549, 461, 453, 551; 273/DIG. 30
See application file for complete search history.

(56) References Cited

U.S. PATENT DOCUMENTS 3,408,075 A * 10/1968 Colton ..... 473/204
3,670,574 A 6/1972 Edwards
3,687,458 A * 8/1972 Proctor, Jr. ..... 473/204
4,488,726 A 12/1984 Murray
4,861,034 A 8/1989 Lee
4,930,785 A 6/1990 Mills
5,018,734 A * 5/1991 Allsop ..... 473/551
5,377,541 A 1/1995 Patten
5,419,563 A 5/1995 Abrams et al.
5,439,217 A 8/1995 Ganger, Sr.
5,733,201 A 3/1998 Caldwell et al.
5,762,563 A * 6/1998 Holzhausen ..... 473/206
5,771,492 A 6/1998 Cozza
6,923,727 B1 * 8/2005 Jacobs ..... 473/206
2002/0194668 A1 12/2002 Kwon

* cited by examiner

*Primary Examiner*—Nini F. Legesse
(74) *Attorney, Agent, or Firm*—Gregory J. Gore

(57) ABSTRACT

A golf grip-training device includes a main body having attachment means for securement to a golf club by snap-fit in the area of the golf club grip where a golfer's hands are placed. The attachment means is preferably a collar which receives the club shaft. A deformable grip element is affixed to the main body by a living hinge and further includes a gap between the grip element and the main body. A tactile sensory stimulator is affixed to the main body and located within the gap whereby excessive deformation of the grip element causes the stimulator to project beyond the grip element and into contact with at least one of the golfer's hands. The grip element may further includes an aperture through which the stimulator extends when the grip element is excessively deformed.

7 Claims, 1 Drawing Sheet

GOLF GRIP-TRAINING DEVICE

FIELD OF THE INVENTION

The present invention relates to training devices for the game of golf. More specifically, it relates to a grip pressure indicator to help golfers maintain the proper amount of grip as they swing the golf club and strike the ball.

BACKGROUND OF THE INVENTION

A very important part of properly executing the golf swing is the correct amount of grip pressure. The average golfer tends to grip the club too tightly, exerting excessive force on the club which is detrimental to accuracy and distance that the golf ball travels. It is therefore desirable to have a training device which will teach the golfer not to grip the club too tightly. When practicing with a relaxed grip the golfer can, by muscle-memory, develop the beneficial habit of a more relaxed golf grip pressure to increase his skill in playing the game.

There have been various attempts in the art for creating golf grip pressure training systems to improve a golfer's play of the game. These systems are primarily in the form of training gloves which include a sensory feedback mechanism such as an electronic pressure pad or other sensory measurement device. Some prior art pressure recognition devices are connected to an output signaling device such as a light-emitting lamp or sound alarm. Examples of these devices are disclosed in U.S. Pat. No. 5,733,201 entitled "Golf Training Glove" issued to Caldwell et al. and U.S. Patent Application Publication No. 2002/0194668 by Kwon entitled "Functional Golf Gloves."

While these devices may be advantageous in theory, as a practical matter the electrical circuits can be delicate and unreliable for such a rugged outdoor sports application. Furthermore, the devices require battery power which can also be unreliable and which needs to be either recharged or replaced regularly. Finally, these devices are relatively expensive and require specialty manufacturing. There is therefore a need in the art for an effective and easy to use grip pressure training device for golfers which is reliable, uncomplicated, requires no maintenance, and inexpensive to manufacture.

SUMMARY OF THE INVENTION

In order to meet the needs in the art, the present golf grip-training device has been created. The device is a simple accessory which is attachable to the golf club in the area of the grip. It is attachable by snap-fit and is located between the golfer's hand and the club. The device is a simple unitary item which is extremely inexpensive to produce and easy to attach or remove from one golf club to another as different clubs are used.

The device includes three major components: a main body having club attachment means, a hinge component, and a deformable grip element. The grip element includes an aperture through which a sensory element attached to the main body portion can project under conditions of excessive grip pressure. The operation is simply explained as follows: when correct pressure is applied, the grip element does not deform and no stimuli from the sensory element is felt. However, when the grip pressure is excessive, the hand grip element deforms to the point where the stationary sensory element, usually a sharp edged projection, passes through and beyond the grip element into contact with the hand of the golfer. This provides a tactile feedback in response to excess grip pressure and thus is effective in helping train golfers to reduce their grip force.

More specifically, the applicant has invented a plastic golfer's grip-training device comprising a main body having attachment means for securement to a golf club shaft by snap-fit in the area of the golf club grip where a golfer's hands are placed. The attachment means is preferably a collar which receives the club shaft. A deformable grip element is affixed to the main body by a living hinge and further includes a gap between the grip element and the main body. A tactile sensory stimulator is affixed to the main body and located within the gap whereby deformation of the grip element causes the stimulator to project beyond the grip element and into contact with at least one of the golfer's hands. The grip element may further includes an aperture through which the stimulator extends when the grip element is excessively deformed.

It is therefore a main object of the invention to provide a golfer's grip pressure training device which is durable, reliable, inexpensive to manufacture, and effective. It is a further object of the invention to provide a simple and effective grip-training device which requires no maintenance, is entirely mechanical, and requires no electricity or power source. Other objects and advantages will be apparent to those of skill in the art from the following drawings and description of the preferred embodiment.

DESCRIPTION OF THE PREFERRED EMBODIMENT

Figure 1:
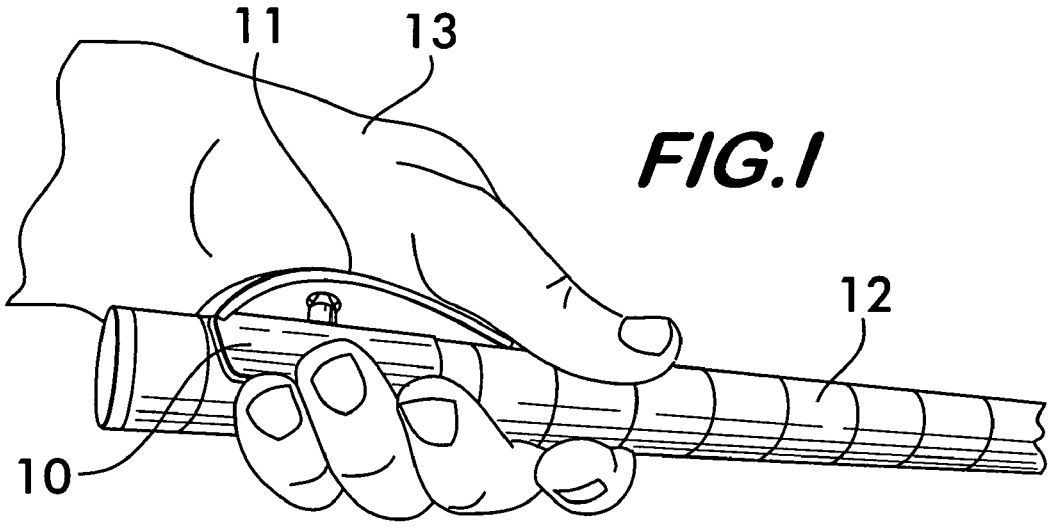
FIG. 1 is a bottom left side perspective view showing the training device of the invention located beneath the golfer's hand.

Referring now to FIG. 1, the present grip-training device 11 is shown fitted in the grip area around a golf club shaft 12. As will be more clearly depicted in the following drawings, the device is positioned directly beneath the palm of a golfer's hand. With a right-handed golfer, this is preferably the palm of the left hand 13. The device is affixed to the club by snap-fit of a resilient collar 10.

Figure 2:
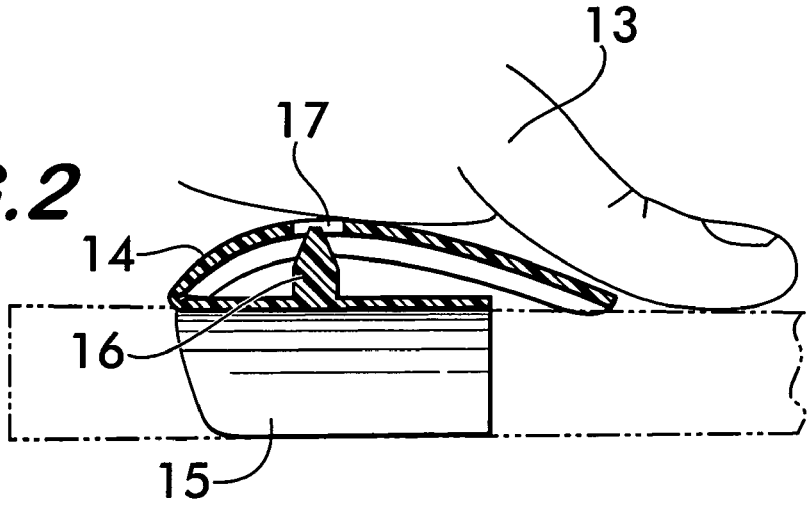
FIG. 2 is a left side elevation sectional view with the club shaft shown in phantom.

Referring now to FIG. 2, greater detail of the invention is shown. The device includes a curved deformable element 14 which extends directly beneath and directly against the palm of hand 13. A main body portion 15 includes an upward extending tactile stimulator 16 which is positioned directly below an aperture 17 through the deformable element 14.

Figure 3:
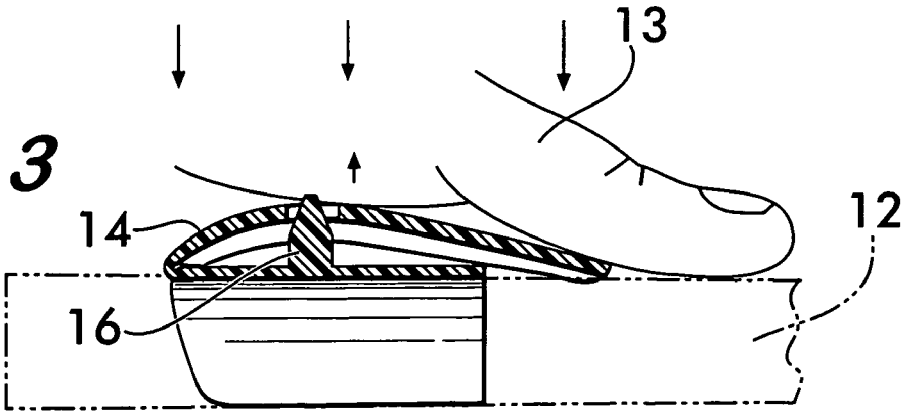
FIG. 3 is a left side elevation sectional view showing movement of the hand with respect to the training device of the invention.

As depicted in FIG. 3, when the golfer's hand 13 grips the club 12, pressure is exerted in the direction of the arrows between the palm of the hand and the deformable element 14. This causes element 14 to collapse downwardly against the club shaft and for stimulator 16 to extend through the aperture 17 and into direct contact with the golfer's palm. This creates an immediate sensation to the golfer's hand. The materials of the device are preferably composed of a plastic of selected resilience such that the above-described point of deformation whereby the sensory element contacts the user's hand at a point when excessive grip pressure has been applied. Thus, if too much pressure is applied, the golfer receives a stimulus and if a lesser amount of pressure is applied, i.e. the correct amount, no stimulation is felt. In this way, the device acts as a negative feedback training tool for training golfers to apply less grip pressure.

It should be understood that there may be other modifications and changes to the present invention that will be obvious to those of skill in the art from the foregoing description, however, the present invention should be limited only by the following claims and their legal equivalents.

What is claimed is:

1. A golfer's grip-training device, comprising:

a main body having attachment means for securement to a golf club shaft in the area of the golf club grip;

a deformable grip element affixed to said main body for placement beneath the golfer's hands and further including a gap between said grip element and said main body; and a tactile sensory stimulator affixed to said main body and located within said gap whereby deformation of said grip element by the golfer's grip pressure causes said stimulator to project beyond said grip element and into contact with at least one of said golfer's hands.

2. The training device of claim 1 wherein said main body and said grip element are unitary.

3. The training device of claim 2 wherein said main body and said deformable grip are joined by a living hinge.

4. The training device of claim 3 wherein said grip element further includes an aperture through which said stimulator extends when said grip element is deformed.

5. The training device of claim 2 wherein said training device is composed entirely of a plastic material.

6. The training device of claim 1 wherein said attachment means provides a snap-fit attachment to the golf club shaft.

7. The training device of claim 1 wherein said attachment means is a collar which receives the club shaft.

* * * * *